US005727589A

United States Patent [19]

Yokogi

[11] Patent Number: 5,727,589

[45] Date of Patent: Mar. 17, 1998

[54] GAS SUPPLY SYSTEM EQUIPPED WITH CYLINDERS

[75] Inventor: Kazuo Yokogi, Tokyo, Japan

[73] Assignee: Teisan K.K., Tokyo, Japan

[21] Appl. No.: 348,801

[22] Filed: Nov. 28, 1994

[30] Foreign Application Priority Data

Nov. 29, 1993 [JP] Japan ..... 5-298725

[51] Int. Cl.[6] ..... B08B 9/02; B08B 9/06

[52] U.S. Cl. ..... 137/240; 141/85; 141/89; 141/98; 222/148

[58] Field of Search ..... 137/240; 134/165 C, 134/167 C, 168 C, 169 C, 902; 141/85, 89, 98; 222/148

[56] References Cited

U.S. PATENT DOCUMENTS

| | | | |
|---|---|---|---|
| 4,120,331 | 10/1978 | Krivanek, III | 137/240 |
| 4,169,486 | 10/1979 | Otteman et al. | 137/240 |
| 4,383,547 | 5/1983 | Lorenz et al. | 137/240 |
| 4,554,942 | 11/1985 | Williams et al. | 137/240 |
| 4,741,354 | 5/1988 | DeMild, Jr. | 137/240 |
| 4,869,301 | 9/1989 | Ohmi et al. | 137/240 |
| 4,917,136 | 4/1990 | Ohmi et al. | 137/240 |
| 5,069,244 | 12/1991 | Miyazaki et al. | 137/240 |
| 5,137,047 | 8/1992 | George | 137/240 |
| 5,368,062 | 11/1994 | Okumura et al. | 137/240 |

FOREIGN PATENT DOCUMENTS

| | | |
|---|---|---|
| 0 251 917 | 1/1988 | European Pat. Off. . |
| 0 473 040 | 3/1992 | European Pat. Off. . |
| 0 546 280 | 6/1993 | European Pat. Off. . |

OTHER PUBLICATIONS

Patent Abstracts of Japan, vol. 8, No. 276 (M-346), Dec. 18, 1984, JP-A-59 145425, Aug. 20, 1984.

Patent Abstracts of Japan, vol. 11, No. 1 (M-550), Jan. 6, 1987, JP-A-61 180831, Aug. 13, 1986.

*Primary Examiner*—George L. Walton

*Attorney, Agent, or Firm*—Oblon, Spivak, McClelland, Maier & Neustadt, P.C.

[57] ABSTRACT

A gas supply system equipped with cylinders, in which the fear of a dangerous feed gas flowing backward to a purge gas introduction line and the likes can be prevented, is provided.

[Construction]

A piping portion B1 which becomes a negative pressure area is demarcatedly formed in a purge gas introduction line B by arranging two valves V3 and V7 in series therein, and in the piping portion B1 demarcatedly formed by these two valves V3 and V7, a gas in the piping portion B1 is led to a vent line D through a vent line D2 having a third valve V8 provided therein, and a pressure sensor 12 is placed for detecting the gas pressure in the piping portion B1. If any trouble takes place in the valve V3 or valve V8, a raise in pressure will be generated in the piping portion B1 in which the inner volume thereof is made small. By detecting this raise in pressure by the pressure sensor 12, the fear of a feed gas flowing backward to the purge gas introduction line B can be quickly detected.

16 Claims, 11 Drawing Sheets

GAS SUPPLY SYSTEM EQUIPPED WITH CYLINDERS

DESCRIPTION OF THE INVENTION

1. Technical Field

The present invention relates to a gas supply system equipped with cylinders for supplying a feed gas necessary for manufacture of semiconductors from a cylinder to a semiconductor manufacturing unit.

2. Prior Arts

In the manufacture of semiconductors, a feed gas necessary therefor is supplied from a cylinder 1 to a semiconductor manufacturing unit 2 (a dangerous gas having toxicity or combustibility such as silane or phosphine is often used as the feed gas). For making provision against an emergency of gas leakage, as shown in FIG. 6, the said cylinder 1 is usually accomodated in a gas supply apparatus in which air in the inside thereof is ventilated at all times, this is called a cylinder cabinet 3.

The said cylinder cabinet 3 is constructed, as shown in the same figure, in the form of a vertically long box having an exhaust damper 4 provided on its ceiling, wherein a door (not shown) for putting the cylinder 1 therein or therefrom is hinged for movement between the open position and the close position on the opened front thereof. For making provision against an emergency of gas leakage, the cylinder cabinet 3 has a gas leakage detection and warning device (not shown) attached in the inside thereof for quickly detecting a gas leakage. In the inside of the cylinder cabinet 3 is arraned a gas supply line A composed of a metallic pipe (this is usually a small pipe made of stainless steel) passed through the pressure resistance and gas-tightness test, as shown in FIG. 6 and FIG. 7. And also in the inside of the cylinder cabinet 3 are respectively arranged, other than this gas supply line A, a purge gas introduction line B, a gas-tightness checking gas introduction line C and a vent line D, each composed of a metallic pipe passed through the same pressure resistance and gas-tightness test, in a condition that they are associated with one another.

The said gas supply line A functions to lead a feed gas flowing out of the cylinder 1 to the semiconductor manufacturing unit 2. as the main valve 5 of the cylinder 1 is opened. The uppermost stream portion A1 of this gas supply line A is wound in the form of a coil so as to absorb the difference in height of the mouthpieces of respective cylinders 1 which are somewhat different, and connected to the cylinder mouthpiece portion 6 thereof. After the feed gas is passed from the cylinder 1 through the uppermost stream portion A1, thus, it is led to a reducing valve V2 by way of a sluice valve (hereinafter called a high-pressure isolation valve) V1 which is usually positioned downstream of this uppermost stream portion A1, and reduced in pressure to a pressure utilizable in the semiconductor manufacturing unit 2 by means of this reducing valve V2, and after the feed gas is led from the reducing valve V2 to the supply outlet Ae of the cylinder cabinet 3, it is supplied from this supply outlet Ae to the semiconductor manufacturing unit 2 through a single pipe 7. In addition, a sluice valve (called a low-pressure isolation valve) (not shown) may be provided between the reducing valve V2 and the supply outlet Ae of the cylinder cabinet 3. However, in a case where a gas that is liquefied in the cylinder 1 such as dichlorosilane is used, such a reducing valve and a low-pressure isolation valve associated therewith may not be disposed in the inside of the cylinder cabinet 3, due to consideration of the fact that its original pressure is low.

The said purge gas introduction line B functions to substitute a dangerous gas remaining in the pipes with a safe gas such as nitrogen before the exchange of the cylinder 1, or lead, in order to eliminate some contamination in the pipes, which may be caused by foul outdoor air flowing therein in the exchange of the cylinder 1, a clean inert purge gas (this is usually nitrogen) to the contaminated pipes so that they are cleaned up. As a method for introducing this purge gas, there are two methods, one (no shown) comprising placing a purge gas cylinder in the cylinder cabinet 3, reducing the pressure of a purge gas from this purge gas cylinder to a pressure to be used for purge by a reducing valve for purge gas and introducing the purge gas reduced in pressure, and the other (see: FIG. 9 and FIG. 10) comprising reducing the pressure of a purge gas from a purge gas cylinder N separately placed outside of the cylinder cabinet 3 to a pressure to be used for purge and introducing the purge gas reduced in pressure. In any of these method, the purge gas introduction line B is designed so as to join the cylinder mouthpiece portion 6 of the gas supply line A by way of one purge gas introduction valve V3 or a plurality thereof. In addition, this joining point may be positioned closely to the cylinder mouthpiece 6 or downstream separately from the uppermost stream portion A1 of the gas supply line A, and in any case, the purge gas introduction line B is designed so as to join the gas supply line A between the cylinder mouthpiece portion 6 and high-pressure isolation valve V1 thereof. The former structure relating to the joining point is called "a deep purge structure" and the latter structure relating thereto is called "a cross purge structure", and between both these structures which are only different in the joining portion, there is no difference in operation.

The said gas-tightness checking gas introduction line C functions to lead an inert, high-pressure gas for the gas-tightness checking use (this is usually nitrogen, helium or a helium and nitrogen mixture, or argon) to the cylinder mouthpiece portion 6 of the gas supply line A in order to check the gas-tightness of the cylinder mouthpiece portion 6 after it is connected again in the exchange of the cylinder 1. This gas-tightness checking gas introduction line C is constructed in a similar structure to the purge gas introduction line B, and designed so as to join the cylinder mouthpiece portion 6 of the gas supply line A by way of one sluice valve V4 or a plurality thereof.

As the aforementioned purge gas and gas-tightness checking gas, there is used an inert gas such as nitrogen, argon or helium. Usually, nitrogen gas is used for both the purge gas and gas-tightness checking gas, but they are different in supply pressure. Namely, a purge gas is usually supplied at 5~6 kg/cm$^2$ G, while a gas-tightness checking gas is usually supplied at a pressure (maybe 100 kg/cm$^2$ G or more, depending on the kind of a used gas) higher than the purge gas because its pressure must be at least higher than the normal pressure of a feed gas (in this case, this is the filling pressure of a cylinder 1 filled with a feed gas). In a case where a feed gas which is liquefied in the cylinder 1 (such as dichlorosilane) is used, however, the gas-tightness checking gas introduction line C may be omitted in the cylinder cabinet 3 accommodating such feed gas because the internal pressure of the cylinder 1 is low as it is and it is also possible to check the gas-tightness by use of a purge gas.

The said vent line D functions to exhaust, from a single body of the cylinder cabinet 3, a purge gas introduced from the purge gas introduction line B into the cylinder mouthpiece portion 6 of the gas supply line A at the time of purge, without exhausting the purge gas therefrom through the gas supply line A or semiconductor manufacturing unit 2. In other words, the vent line D is of an exhaust line for the purge use. This vent line D is designed so as to be branched from a pipe between the cylinder mouthpiece portion 6 of the gas supply line A and the high-pressure isolation valve V1 of the gas supply line A, this is a piping portion to be purged, and usually equipped with a single sluice valve (which is usually called a vent valve) V5, whereby the purge gas is discharged to the outside of the cylinder cabinet 3 through a vent outlet De.

Recently, in order to improve the purging effect, an ejector type vacuum generator 8 is often attached on the vent line D, as shown in FIG. 8. In the case of a vent line D having such ejector type vacuum generator 8, it is possible to exhaust a dangerous gas remaining in a piping portion to be purged while it is diluted and mixed with nitrogen which drives the ejector. Therefore, the dangerous gas can be exhausted in safety and it can be vacuum-exhausted and as a result, it is possible to improve the purging effect. In addition, nitrogen which drives the ejector is usually introduced from a nitrogen supply source (not shown) placed outside of the cylinder cabinet 3 through an inlet 9, but it may be introduced branchedly from the purge gas introduction line B.

[PROBLEMS SOUGHT FOR SOLUTION BY THE INVENTION]

The gas supply system equipped with cylinders of the prior art is constructed as mentioned above, and it is namely designed so as to handle dangerous gases and to have such a structure that a plurality of lines different in gas pressure and different in purpose are merged and branched. Accordingly, there are the following various problems.

At first, the feat of a dangerous feed gas flowing backward to the purge gas introduction line B will be mentioned as the first problem. Namely, the introducing pressure of a purge gas is usually 5~6 kg/cm$^2$ G, while the pressure of the gas supply line A which a purge gas is to join will be determined by the filling pressure of a feed gas cylinder 1 and it is usually 50 kg/cm$^2$ G or more in many cases differently depending on the kinds of gases and is overwhelmingly larger than the introducing pressure of the purge gas. Accordingly, if the isolating function of a sluice valve is damaged when the feed gas is being supplied to a semiconductor manufacturing unit 2. There would be the fear of the dangerous feed gas flowing immediately backward to the purge gas introduction line B. Disadvantages (including concrete examples) accompanied with this backflow of the dangerous feed gas to the purge gas introduction line B will be enumerated as follows.

(Example 1) In a case where a purge gas is supplied from a cylinder N, for instance, a reducing valve V6 is provided on the side of a purge gas supply apparatus 10, as shown in FIG. 9, in order to reduce the pressure of a high-pressure feed gas in the cylinder N to a pressure to be used for purge. If the high-pressure feed gas flows backwrd to the purge gas introduction line B reduced in pressure, under this condition, the pressure of the purge gas introduction line B will rise abnormally so that the reducing valve V6, whose structure is easily affected by high pressure applied from the secondary side, may be damaged, and as a result, the dangerous feed gas may be permitted to leak. Since this leakage trouble is an unexpected event for users because it Lakes place at the side of the purge gas supply apparatus 10 which is seemingly regarded to have no relation with the feed gas, a very dangerous situation may be caused, when easily failing to pay attention thereto.

(Example 2) Even in a case where such an external leakage accompanied with the damage of the reducing valve V6 as in the above-mentioned Example 1 does not take place, a dangerous feed gas may gush when pipes in the purge gas supply apparatus 10 are decomposed for the purpose of maintainance, although it is expected hat a safe purge gas exists in the pipes. It will be concluded that some troubles may therefore arise in the health of workers and in the worst case, a gas explosion may happen.

(Example 3) Usually in a semiconductor factory, many kinds of feed gases are accomodated in independent situations or in a plurality of sets each consisting of some cylinders collected, respectively in cylinder cabinets 3, without using only one cylinder cabinet 3, and they are supplied under these conditions. As shown in FIG. 10, the introduction of a purge gas to plural cylinder cabinets 3 and 3A is often carried out by use of a single purge gas supply apparatus 10, in order to avoid a useless increase in the scale of installation. If the isolating function between the gas supply line A and purge gas introduction line B of the cylinder cabinet 3 is damaged, in a case where such a supply mode as mentioned above is adopted, a feed gas will flow backward to and get mixed in the purge gas introduction line B while workers do not find out. and the purge of another normal cylinder cabinet 3A will be therefore carried out by a purge gas including the dangerous feed gas mixed therein. If such abnormal condition is left unknown, a cylinder 1 will be exchanged as the purge is unsatisfactory. As a result, there seems a large dangerousness of causing some trouble in the health of workers because the dangerous feed gas may gush toward the workers as soon as they remove the cylinder mouthpiece and piping connection portion. while misjudging that it is safe. The fear of this dangerousness will be described, referring to FIG. 10, wherein such a condition is assumed that a seat leak abnormality takes place in the purge gas introduction valve V3 of a cylinder cabinet 3 which is supplying a feed gas. If a cylinder 1 is exchanged in another cylinder cabinet 3A which owns the purge gas introduction line B jointly, a dangerous gas will leak to the front of workers carrying out the removing operation of said cylinder 1 and this leakage is danger because the dangerous gas is still remaining in the pipings, even when the purge (this is a purge for substituting the dangerous gas remaining in the pipings with a safe purge gas) has been carried out in a normal method before the removal of the cylinder 1.

(Example 4) Although the aforementioned Example 3 is an example which comes into problem, also in a case where the purge gas introduction line B is common in the cylinder cabinets 3 and 3A for the same kind of a feed gas, there is a more dangerous case. Namely, it is a case using a combination of feed gases, wherein if they are mixed, an abnormal reaction will be caused to happen, this is called a mixed-contacting dangerousness. In a semiconductor factory, for instance, there are used many gases having the mixed-contacting dangerousness such as a combination of silane and nitrogen peroxide. If such gases are supplied from the same purge gas supply apparatus 10, there will be the following dangerousness. Namely, if a feed gas flows backward to the purge gas introduction line B in such a case, a mixed gas which must not be produced will be formed in pipes or a cylinder 1 or 1A, and as a result, the pipes or the cylinder 1 or 1A may be exploded in themselves (This is an example happened in fact). Although such a purge gas introduction line B of a cylinder cabinet 3 should be originally separated from a feed gas supply line for such feed gas having the mixed-contacting dangerousness, it has been hitherto synthesized with the feed gas supply line in many cases.

(Example 5) Although the problem on the plural cylinder cabinets 3 is presented in the abovementioned Example 3, a problem similar thereto may arise even in the case of a single cylinder cabinet 3. Namely, the single cylinder cabinet used here is a cylinder cabinet 3 of the feed gas continuous supply type constructed so that two cylinders 1 are accomodated in a single cylinder cabinet 3 and the supply of a feed gas is carried out from one of these two cylinders 1, whereby while the feed gas is being supplied from one cylinder 1, the other used cylinder 1 can be purged and exchanged with a new cylinder 1, without stopping the supply of the feed gas. If the isolating function is therefore damaged on the side of the purge gas induction line B supply, in this case, the same dangerousness as in the aforementioned Example 3 will be caused to arise in the cylinder 1 to be exchanged because the purge gas introduction line B is common for the two cylinders 1. In addition, this dangerousness is more or less a problem belonging to a cylinder cabinets 3 of the two-cylinders switching-over type which are presently in operation.

In the next place, the fear of a dangerous feed gas flowing backward to the gas-tightness checking gas introduction line C will be mentioned as the second problem. As mentioned above, the introducing pressure of a gas-tightness checking gas is set so as to be higher as compared with the introducing pressure of a purge gas. It is therefore noticed that the inducing pressure of the gas-tightness checking gas is usually higher than the supplying pressure of the gas supply line A into which the gas-tightness checking gas introduction line C is to be merged. In the gas-tightness checking gas introduction line C, accordingly, this risk seems to be smaller as compared with the purge gas introduction line B. Since the introducing pressure of the gas-tightness checking gas introduction line C is not always higher than the supplying pressure of the feed gas at all times when a cylinder N on the side of a gas-tightness checking gas supply apparatus is exchanged or in maintainance, however, there is some risk at least. Even when the pressure of the gas-tightness checking gas is higher than that of the feed gas, a sheet leak may take place, and if said seat leak is left as it is, without being noticed for a long period of time, the feed gas will flow backward to and get mixed into the gas-tightness checking gas introduction line C due to its diffusing phenomenon. Accordingly, there is the fear of the dangerous feed gas flowing backward to the gas-tightness checking gas introduction line C.

Finally, a trouble on the vent line D will be mentioned as the third problem. Downstream of the vent line D is usually provided a harmfull substance remover 11 as shown in FIG. 11, where after a dangerous gas exhausted from the cylinder cabinet 3 is made harmless by the harmfull substance remover 11, it is discharged to the atmosphere. Since the harmfull substance remover 11 can be regarded as an atmosphere-opened system because the fluid resisance therein is lower as can be neglected at all due to its use, the pressure of the vent line D is usually as low as the atmospheric pressure. Therefore, there is the fear of a dangerous feed gas flowing out to the vent line D, due to consideration of such a possibility that a seat leak abnormality will take place in a vent valve V5 or the vent valve V5 may be opened by an error operation when the feed gas is being supplied from the cylinder cabinet 3 to the semiconductor manufacturing unit 2. If any equipment trouble takes place in the valve (vent valve) V5 which isolates the vent line D and gas supply line A so that the feed gas flows continuously out to the vent line D while anyone does not know in supply of the feed gas, the harmful substance remover 11 is immediately deteriorated in capacity so that the dangerous gas which is not sufficiently freed of harmful substances is discharged to the atmosphere. This becomes a serious problem in the viewpoints of safety, health and protection of environment. The most serious problem on the vent line D is as follows. Namely, if the vent valve V5 is opened in error under a worker's mistake while the feed gas is being supplied to the semiconductor manufacturing unit 2 (at that time. The container valve of a cylinder 1 gets opened), a large amount of the high-pressure feed gas will flows into the vent line D so that serious damages are given on the vent line D and harmful substance remover 11 which are designed and manufactured so as to be used at a low pressure as a premise, and as a result, a gas leakage will occur in the vent line D and in the worst case, a gas explosion will be caused. In addition, in a case where a vacuum pump for vacuum exhaust of the vent line D is placed therein, the vacuum pump may be damaged in its casing because it is originally affected easily by positive pressure. Thereby, the dangerous feed gas leaks in a large amount and a unit accommodating the vacuum pump may be gas-explosed. In the past, such an explosive trouble has been caused in fact.

As methods for solving the aforementioned problems, the following easy methods have been merely adopted at the present time. Namely, a backflow preventing countermeasure based on a combination of a sluice valve and a single check valve or a plurality of them is taken, on the purge gas introduction line B and on the gas-tightness checking gas introduction line C, and a flow restricting throttle (orifice) is inserted or a reducing valve is placed in the vent line D in order to restrain a raise in pressure, on the vent line D. And as a countermeasure for compensating the weak points which the isolating function in the piping structure of a cylinder cabinet 3 has, there is such a method that a line and a supply apparatus for supplying a purge gas to a cylinder cabinet 3 are provided separately for each of cylinders 1, and this method is now practically adopted in a small-sized factory or laboratory installation. However, it goes without saying that this method is disadvantageous in cost because of an enlarged scale of installation and further this method is still unsatisfactory because it can not improve at all the dangerousness of a feed gas leaking on the side of a purge gas supply apparatus 10, mentioned in the above Examples 1 and 2, or the problem which a cylinder cabinet 3 of the type that two cylinders 1 are accomodated and switched over for use has, i.e. the problem as mentioned in the above Example 5, although it is effective for the mixed centering of a feed gas by way of a purge gas introduction line B between plural cylinder cabinets 3. Although such a method that two sluice valves are arranged in series in the purge gas introduction line B, thereby reducing a seat leak risk of the sluice valves, has been adopted in part, furthermore, this method is not a complete countermeasure.

Due to consideration of the aforementioned facts, the present invention is intended to provide a gas supply system equipped with cylinders, in which the abovementioned problems can be solved.

Means for Solution of the Problems

In order to achieve the aforementioned purpose, according to the present invention, there is provided a gas supply system equipped with cylinders, which comprises a gas supply line for leading a feed gas from a cylinder to a gas consumption means, a line for leading an inert gas to said gas supply line, a negative pressure area formed with a flow path blocking means provided therein, and a detection means for detecting the variation in gas pressure in said negative pressure area, wherein the inflow of said feed gas to the inert gas line or the inflow of said inert gas to the feed gas supply line is detected on the basis of the detection of said detection means.

Also in order to achieve the aforementioned purpose, according to the present invention, there is provided a gas supply system equipped with cylinders, which comprises a feed gas filled in a plurality of cylinders respectively, gas supply lines for separately leading the feed gas from the plurality of said cylinders to a gas consumption means respectively, and lines for leading an inert gas from a single inert gas supply source to the plurality of said gas supply lines respectively, wherein a negative pressure area is formed, with a flow path blocking means provided therein, at least between said feed gas supply lines and said inert gas lines, a detection means is placed for detecting the variation in gas pressure in said negative pressure area, and the inflow of said feed gas to the inert gas lines or the inflow of said inert gas to the feed gas supply lines is detected on the basis of the detection of said detection means.

Further in order to achieve the aforementioned purpose, according to the present invention, there is provided a gas supply system equipped with cylinders, which comprises a plurality of cylinders accomodated in a gas supply apparatus, a feed gas filled in the plurality of said cylinders respectively, gas supply lines whose branched upstream portions are respectively connected to the plurality of said cylinders, for leading the feed gas from a desired cylinder of the plurality of said cylinders to a gas consumption means, and lines for leading an inert gas to the branched upstream portions of the gas supply lines respectively, wherein a negative pressure area is formed, with a flow path blocking means provided therein, at least between the upstream portions of said feed gas supply lines and the inert gas lines, and a detection means is placed for detecting the variation in gas pressure in said negative pressure area, and the inflow of said feed gas to the inert gas lines or the inflow of said inert gas to the feed gas supply lines is detected on the basis of the detection of said detection means.

In the present invention, there is provided a gas supply system equipped with cylinders, in which at least said inert gas line is either a purge gas introduction line for leading a purge gas to the feed gas supply line or a gas-tightness checking gas introduction line for leading a gas-tightness checking gas to the connection portion of said cylinder and gas supply line.

Further in the present invention, there is provided a gas supply system equipped with cylinders, in which the feed gas flowed in the inert gas line or the inert gas flowed in the gas supply line is led to the vent line by way of a vacuum generation means on the basis of the detection of said detection means.

According to the present invention, moreover, there is provided a gas supply system equipped with cylinders, which comprises a gas supply line for leading a feed gas from a cylinder to a gas consumption means, a vent line provided branchedly from the gas supply line for discharging to the outside a gas remaining in the gas supply line for the purpose of purging when the gas supply is stopped, a negative pressure area formed with a flow path blocking means provided therein, and a detection means for detecting the variation in gas pressure in said negative pressure area, wherein the outflow of the feed gas to the vent line is detected on the basis of the detection of said detection means.

Functions

According to the present invention having the aforementioned construction, a gas in one of an area demarcating the feed gas supply line and the inert gas supply line and an area demarcating the feed gas supply line and the vent line or in both of these area is first exhausted to the vent line before the supply of a feed gas, and a flow path blocking means is then closed so that the pressure of a negative pressure area is set at a lower pressure situation than the pressure of the inert gas introduction line and gas supply line at all times. While the feed gas is being supplied to a gas consumption means, it is normally carried out by a detection means to monitor whether the pressure of said negative pressure area rises or not. If any abnormality takes place, in this time, in the isolating function between the inert gas introduction line and feed gas supply line or in the isolating function between the vent line and feed gas supply line, a raise in pressure in the negative pressure area will be caused. Thus, it is possible to detect the abnormality quickly, by detecting this raise in pressure by means of said detection means.

Embodiments

In accordance with one embodiment illustrated in FIG. 1, the present invention will be described here in detail.

The gas supply system equipped with cylinders according to the present invention is constructed, as shown in the same drawing, such that a piping portion B1 which becomes a negative pressure area is demarcatedly formed in a purge gas introduction line (line) B by arranging two valves (flow path blocking means) V3 and V7 in series therein. In the piping portion B1 demarcatedly formed by these two valves V3 and V7, a gas in the same piping portion B1 is led to a vent line D by means of a vent line D2 having a third valve V8 provided therein, and a pressure sensor (detection means) 12 is disposed for detecting a gas pressure in the piping portion B1.

To the said valve V8 is connected the vent line D2, as shown in FIG. 1, and this vent line D2 is connected to the vent line D having a harmful substance remover 11 (see: FIG. 11). In addition, an ejector type vacuum generator 8 is preferably connected to the vent line D2, but this vacuum generator 8 is not always indispensable in the present invention. If the vent line D2 is merged into an existing vent line D provided in the same cylinder cabinet (gas supply apparatus) 3 and an ejector type vacuum generator 8 is in the said vent line D as shown in FIG. 2, however, it is extremely rational in the point of cost to make such a piping arrangement that the vent lines D and D2 own the vacuum generator 8 jointly. Accordingly, it is obvious that the present invention can be employed more effectively.

Now referring to FIG. 2, the effectiveness of the present invention will be described here.

It should be noted that the highest possibility of a feed gas flowing backward and getting mixed in the purge gas introduction line B resides in a time when a cylinder cabinet 3 is supplying the feed gas to a semiconductor manufacturing unit 2 which is a gas consumption installation (gas consumption means). This is based on a reason that the pressure of a gas supply line A at the time when the cylinder cabinet 3 is supplying the feed gas is higher than the purge gas pressure of the purge gas introduction line B. Before the cylinder cabinet 3 gets supplying, accordingly, in the present invention, a gas in the piping portion B1 which demarcates the purge gas introduction line B and a gas supply line A1 is surely vacuum-exhausted (merely exhausted) to the vent line D by opening the valve V8 once, and then the pressure of the piping portion B1 which isolates the purge gas introduction line B and the gas supply line A1 is always kept lower than the pressures of the purge gas introduction line B and gas supply line A, by closing the valve V8. While the feed gas is being supplied to the semiconductor manufacturing unit 2, it is carried out by the pressure sensor 12 to monitor whether the pressure of said piping portion B1 is raised or not at all times. If any abnormality. i.e. a trouble such as seat leak in the valve V3 or valve V8, takes place in the isolating function between the purge gas introduction line B and gas supply line A, a raise in pressure will be generated in the piping portion B1 constructed so that its inner volume is made very small. And, this abnormality can be quickly detected by detecting said raise in pressure by the pressure sensor 12.

Although any abnormality in the isolating function has been detected, it is difficult to conclude that the two valves V3 and V8 get abnormal at the same time. So, it goes without saying that the feed gas does not instantly flow backward to or goes mixed in the purge gas introduction line B. This contributes toward eliminating the dangerousness of a high-pressure feed gas flowing instantly backward to the purge gas introduction line B depending on an erroneous operation. Furthermore, it is possible to exhaust automatically and in safety the gas leaked in the piping portion B1 to the vent line D by hand or in interlock with the pressure sensor 12 in need, and therefore, there is such an effect that the reaffirmation of a leakage situation which is difficult if the supply is not stopped once in a piping of the prior art can be easily carried out. Since this system is designed to prevent the backflow of a feed gas to the purge gas introduction line B every at the joining point of both the lines A and B of each cylinder cabinet 3, it becomes a very effective countermeasure against all the dangerous cases already mentioned in the prior art. This system has advantages not only in preventing the backflow of a feed gas in supply to the purge gas introduction line B. but also in exhibiting a merit in safety even in purge. Namely, by previously checking the introducing pressure of a purge gas before it is supplied to the gas supply line A which is an object to be purged by use of the pressure sensor 12, it is possible to judge whether the purge gas must not be introduced when the said pressure is short. This is a point that has been impossible in the structure of the prior art, and even in this point, the piping structure according to the present invention exhibits a merit in safety.

Moreover, there is such a merit that a purge gas remaining for a long period of time in the purge gas introduction line B is discharged once to the vent line D before it is introduced, whereby a new gas can be always used as the purge gas. This becomes effective especially in a case where a gas purifier is provided in the purge gas introduction line B. Even if a purge gas purified by the gas purifier so as to have a higher purity can be introduced, in a case where the purge gas has been remaining as unused in the pipes for a long period of time, the purity thereof, in particular the dew point (moisture), must be deteriorated due to the degassing from the wall surface of the pipes or the like. The piping structure according to the present invention in which the thus-deteriorated gas can be exchanged with a new purge gas by being discharged directly to the vent line D, not used as the purge gas, has expectantly a larger merit in the viewpoint of gas purity as compared with the piping structure of the prior art.

Even if the piping structure according to the present invention where the isolating function between the two lines described in a part of the purge gas introduction line B has been overwhelmingly enriched in its effect is applied to a gas-tightness checking gas introduction line C and the vent line D, it will be also extremely effective. Namely, FIG. 3 shows an example of the present invention applied to the gas-tightness checking gas introduction line (line) C. In this case, a piping portion C1 which becomes a negative pressure area is demarcatedly formed in the gas-tightness checking gas introduction line C by arranging two valves (flow path blocking means) V4 and V7 in series therein, and in the piping portion C1 demarcatedly formed by these two valves V4 and V7, a gas in the same piping portion C1 is led to the vent line D through a vent line D2 having a third valve V8 provided therein, and a pressure sensor (detection means) 12 is placed for detecting the gas pressure in this piping portion C1. In addition, other portions are the same as in the aforementioned embodiment.

FIG. 4 shows an example of the present invention applied to the vent line (line) D. In this case, a piping portion D1 which becomes a negative pressure area is demarcatedly formed in the vent line D by arranging two valves (flow path blocking means) V5 and V7 in series therein, and in the piping portion D1 demarcatedly formed By these two valves V5 and V7, a pressure sensor (detection means) 12 is placed for detecting the gas pressure in the same piping portion D1. Other portions are also the same as in the aforementioned embodiments.

Furthermore, FIG. 5 shows an applied example extremely high in rationality, where three isolating functions between the gas supply line A and each of the three lines, i.e. the purge gas introduction line B, the gas-tightness checking gas introduction line C and the vent line D, have been easily achieved by one isolated piping structure according to the present invention, without applying the mechanism of the present invention to these three pipe lines separately, and in which a merit in cost and an increase in function can be therefore achieved at the same time. In this case, in addition, a piping portion E which becomes a negative pressure area is demarcatedly formed by arranging fourth valves (flow path blocking means) V3, V4, V7 and V8, and in this piping portion (the dotted area in FIG. 5) E, a pressure sensor (detection means) 12 is placed for detecting the gas pressure in the piping portion E. Other portions are the same as in the aforementioned embodiments.

Although the piping structure in which the pressure sensor 12 is used has been described in the aforementioned embodiments, there is no limit to the pressure sensor 12, so far as a device having a similar function is used.

Effects of the Invention

According to the present invention, as mentioned above, there are obtained remarkable effects, i.e. not only a possibility of reliably preventing the fear of a dangerous feed gas flowing backward to a purge gas introduction line, but also a possibility of reliably preventing such a fear that some trouble in the health of workers is caused, the destruction of environment is promoted or a gas explosion is generated, with the gushing of a dangerous feed gas. There is further obtained a special effect, i.e. a possibility of reliably preventing the fear of a dangerous feed gas flowing backwards to a gas-tightness checking gas introduction line. There is moreover obtained a particular effect, i.e. a possibility of dissolving many evils on the vent line very easily. And there is furthermore obtained such a excellent effect that easy restraint or prevention of a disadvantage in cost, which is accompanied with an increase in the scale of installation, can be expected.

[DESCRIPTION OF THE REFERENCE NUMERALS]

Figure 1:
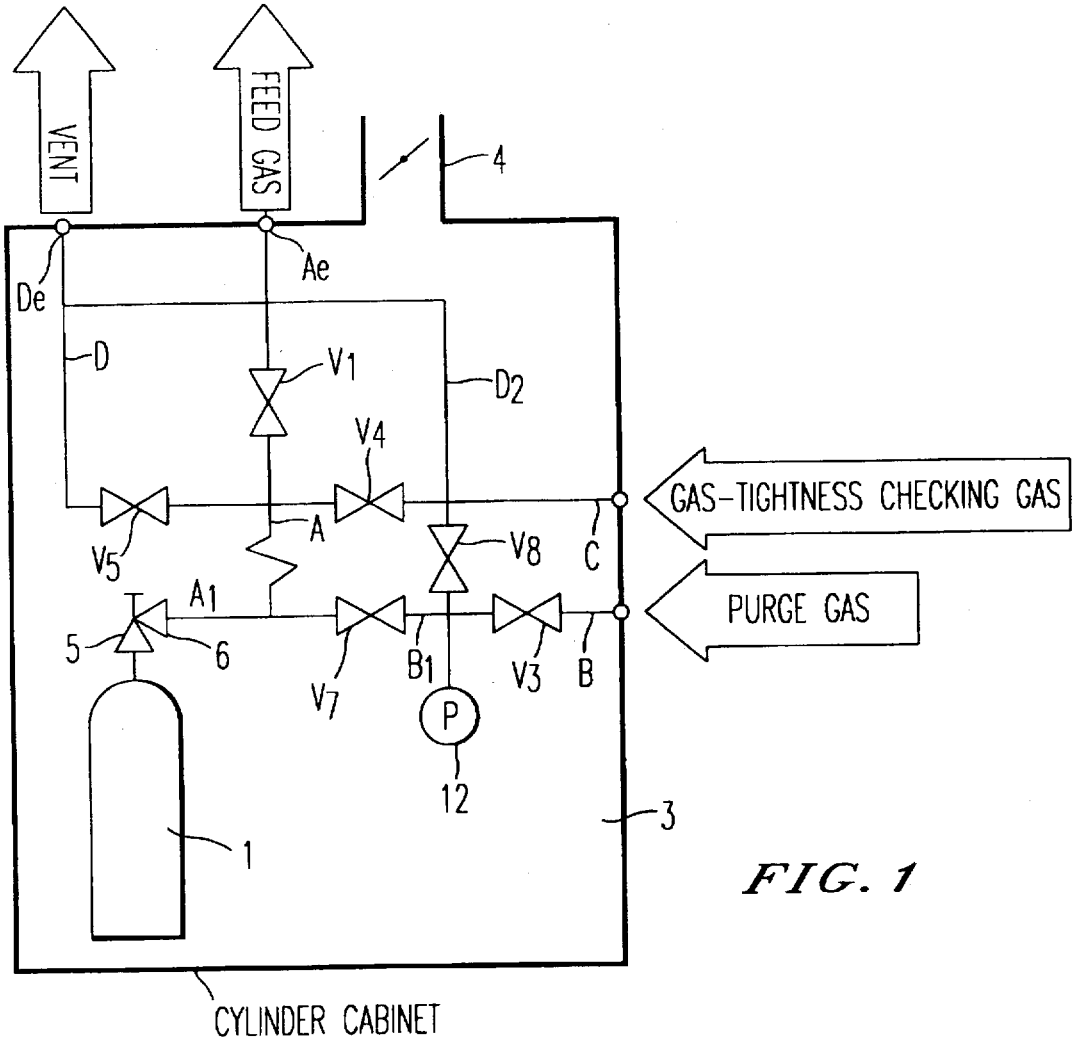
FIG. 1 is an illustrative view showing one embodiment of the gas supply system equipped with cylinders according to the present invention.
Figure 2:
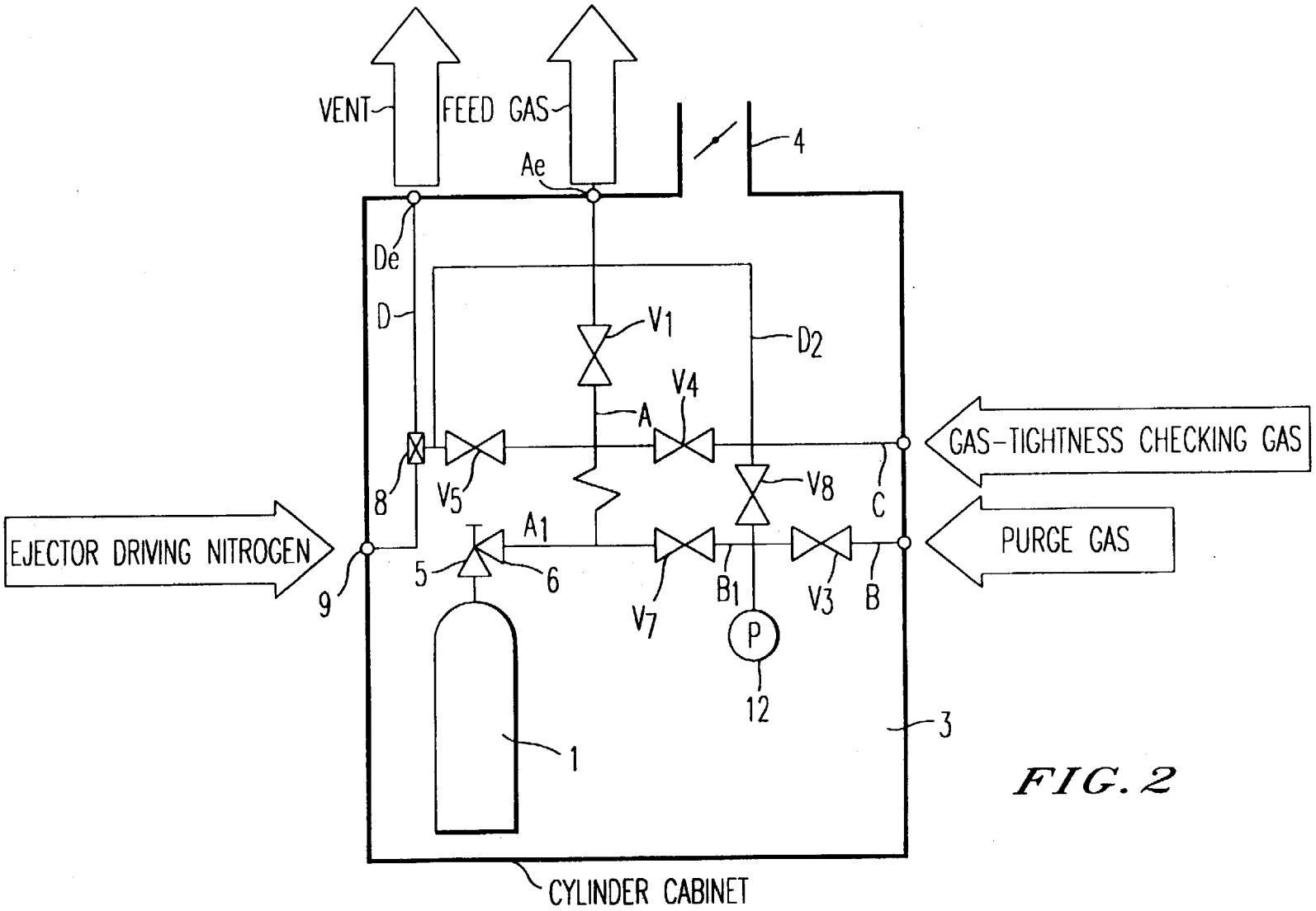
FIG. 2 is an illustrative view showing one embodiment of the gas supply system equipped with cylinders according to the present invention.
Figure 3:
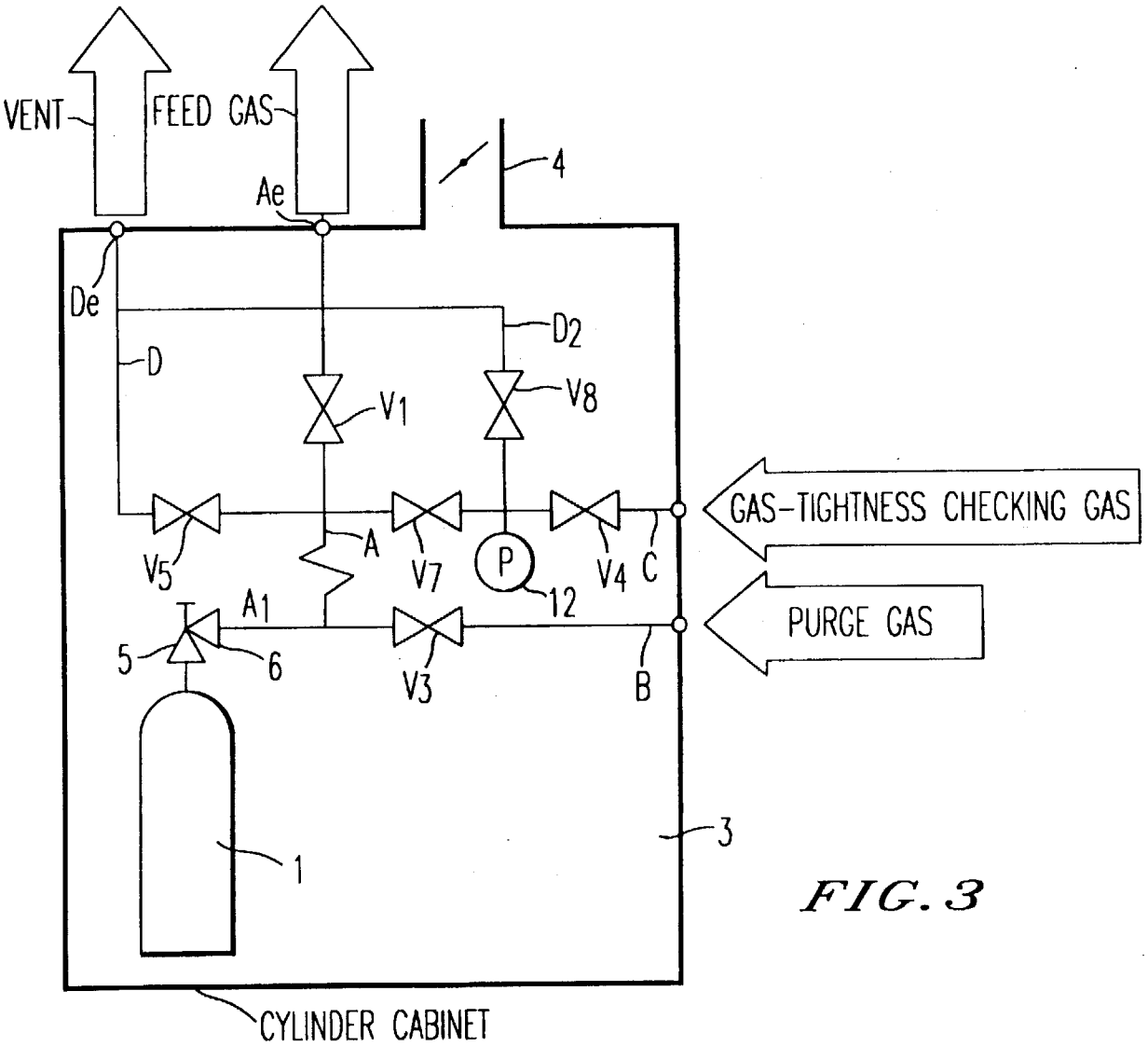
FIG. 3 is an illustrative view showing the second embodiment of the gas supply system equipped with cylinders according to the present invention.
Figure 4:
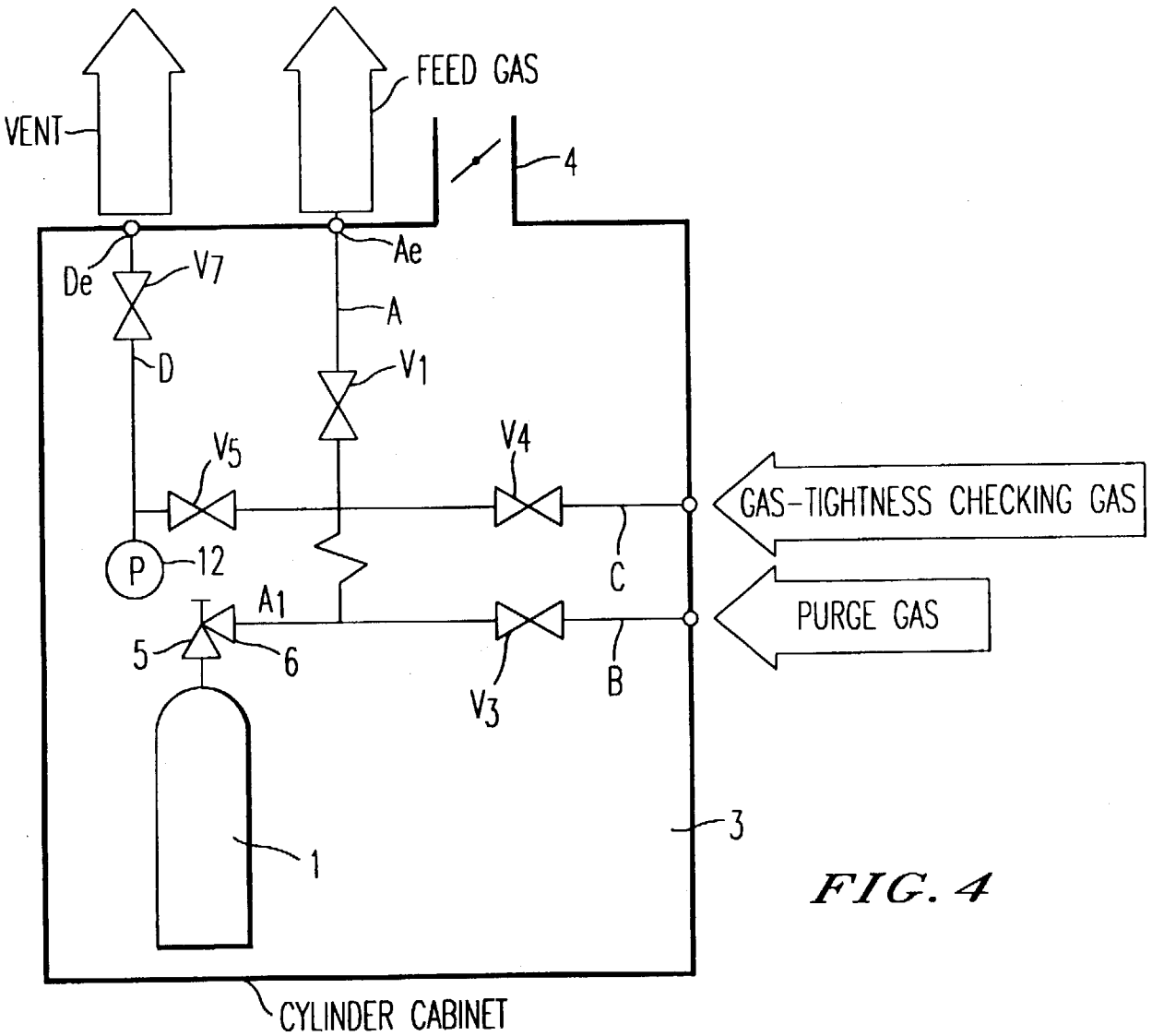
FIG. 4 is an illustrative view showing the third embodiment of the gas supply system equipped with cylinders according to the present invention.
Figure 5:
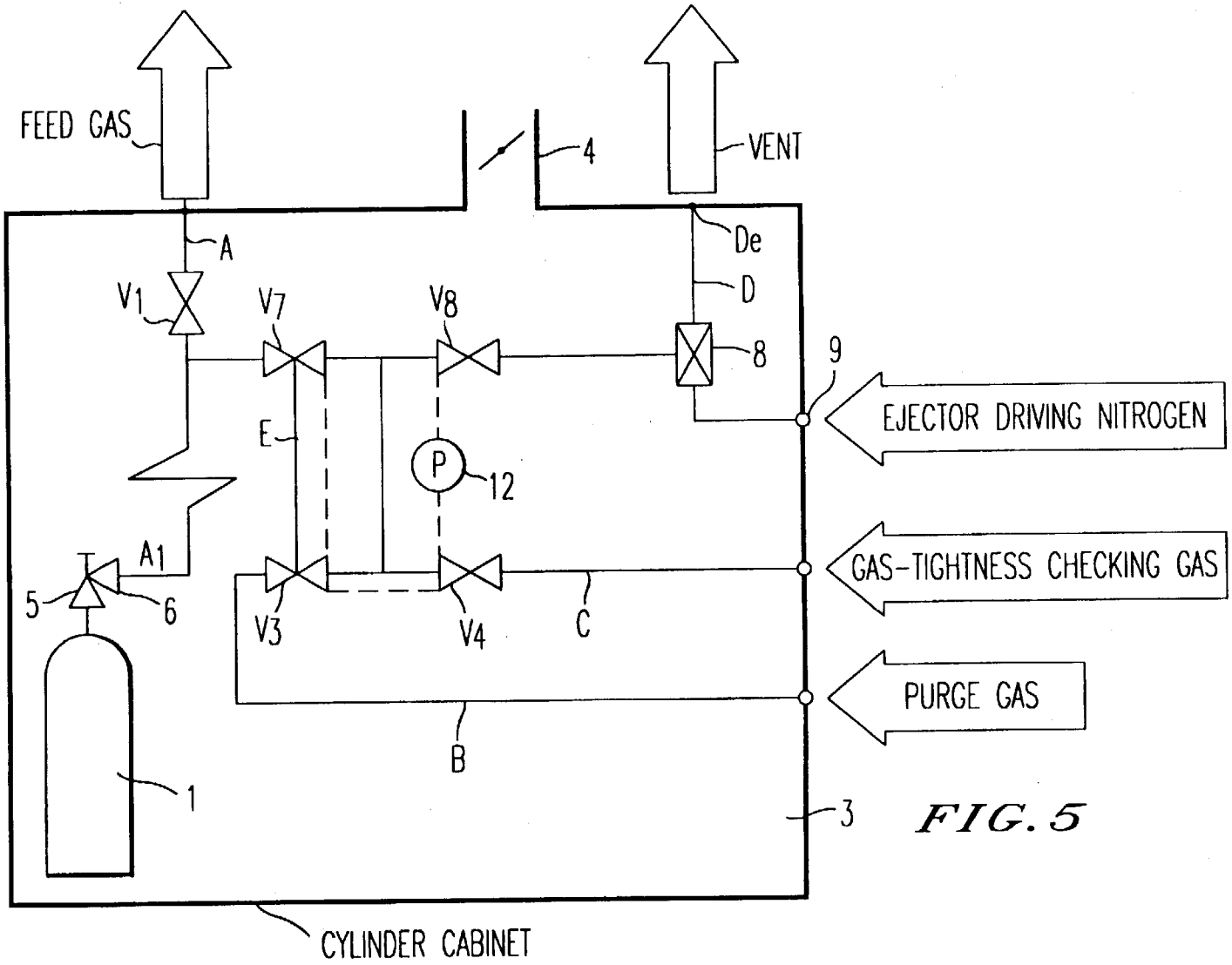
FIG. 5 is an illustrative view showing the fourth embodiment of the gas supply system equipped with cylinders according to the present invention.
Figure 6:
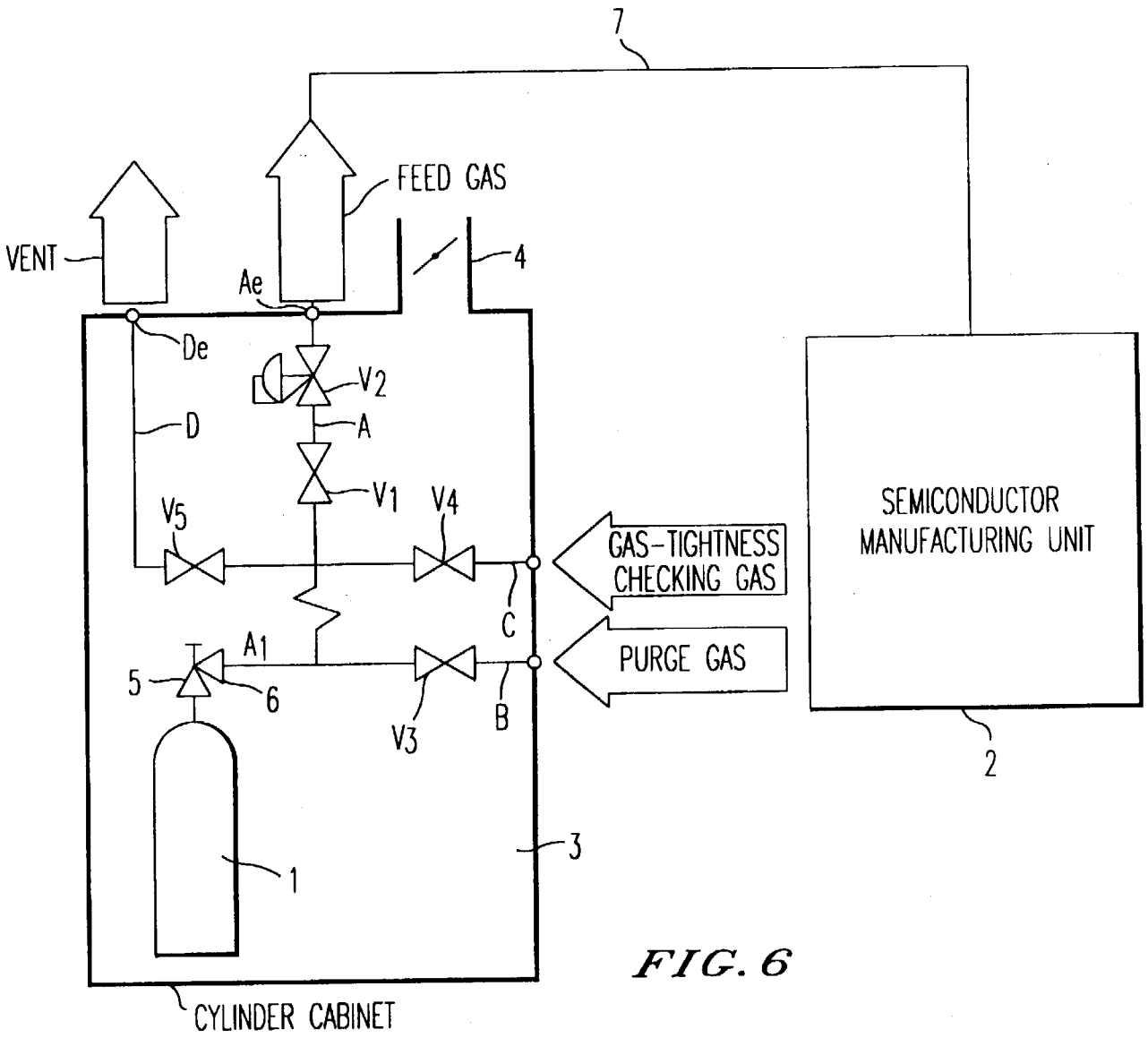
FIG. 6 is an illustrative view showing the gas supply system equipped with cylinders of the prior art.
Figure 7:
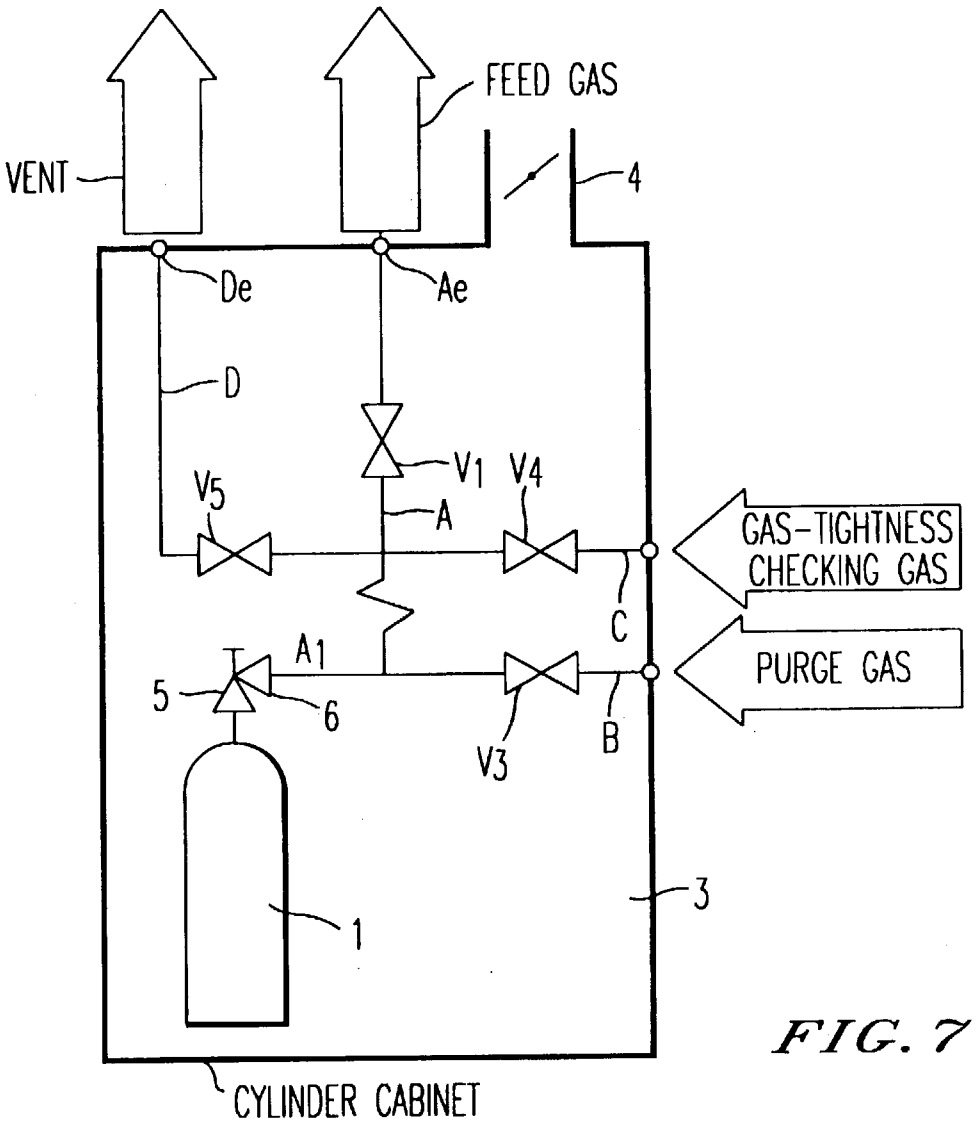
FIG. 7 is an illustrative view showing the gas supply system equipped with cylinders of the prior art.
Figure 8:
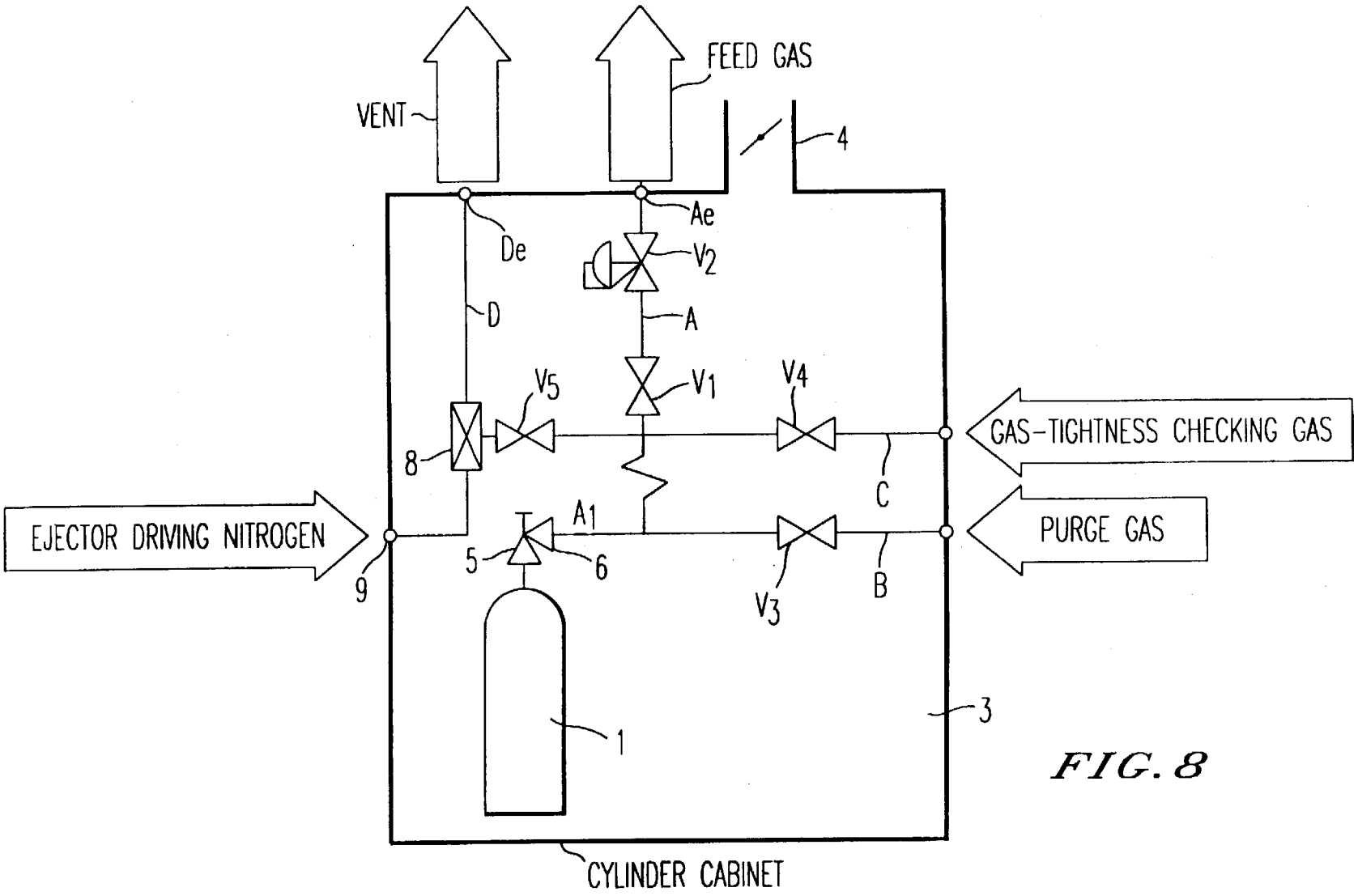
FIG. 8 is an illustrative view showing another gas supply system equipped with cylinders of the prior art.
Figure 9:
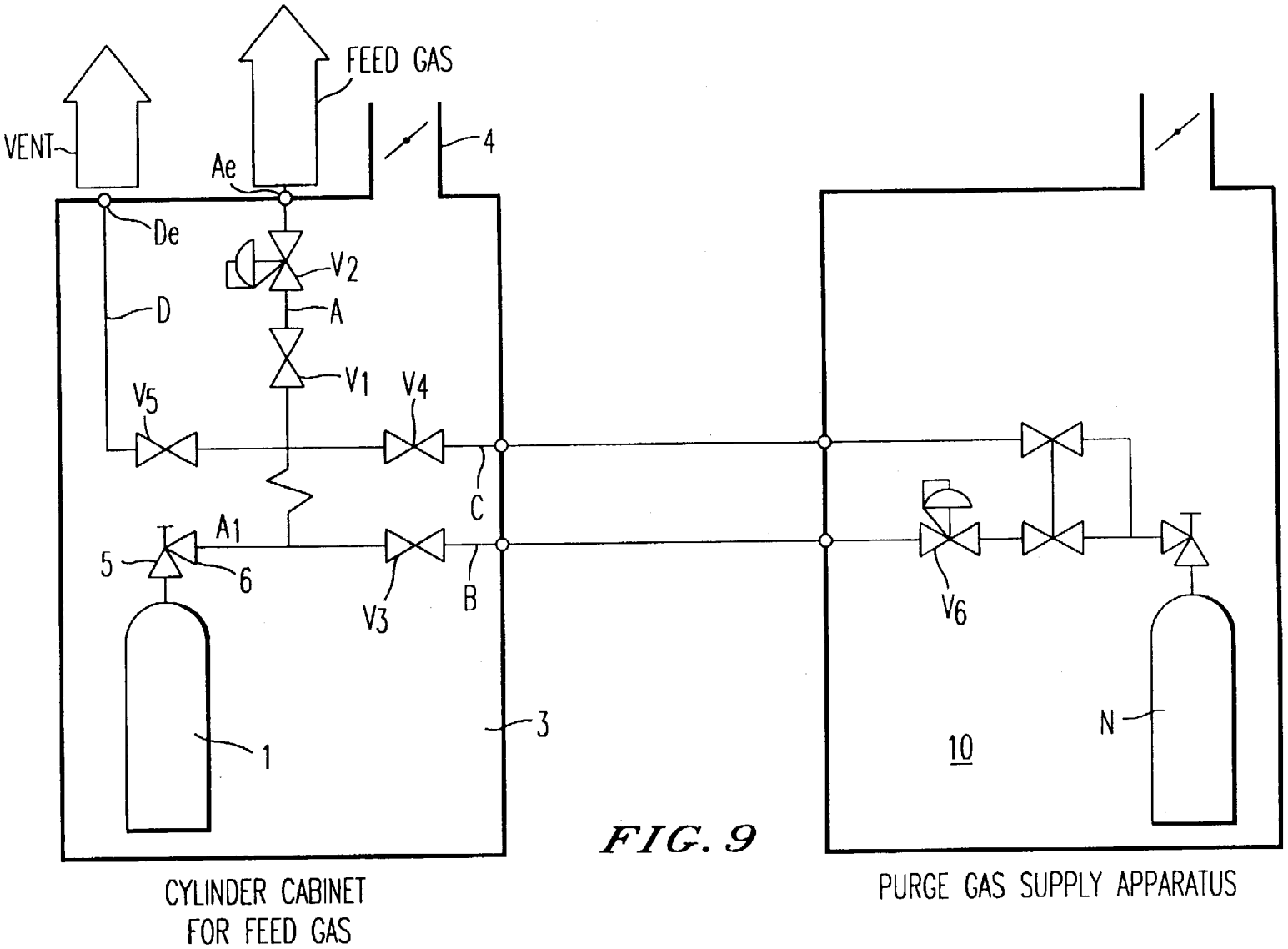
FIG. 9 is an illustrative view showing the problems of the gas supply system equipped with cylinders of the prior art.
Figure 10:
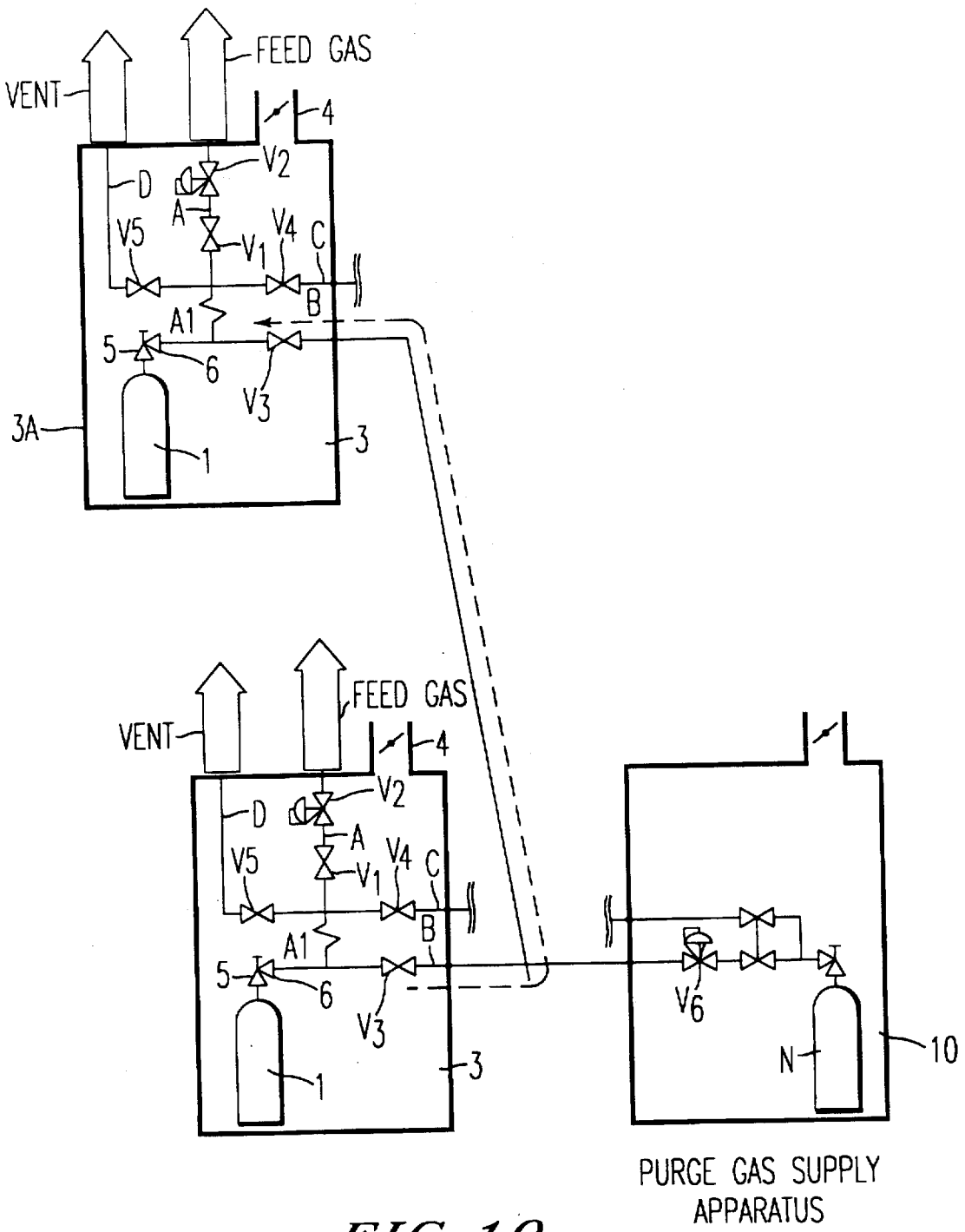
FIG. 10 is an illustrative view showing the problems of the gas supply system equipped with cylinders of the prior art.
Figure 11:
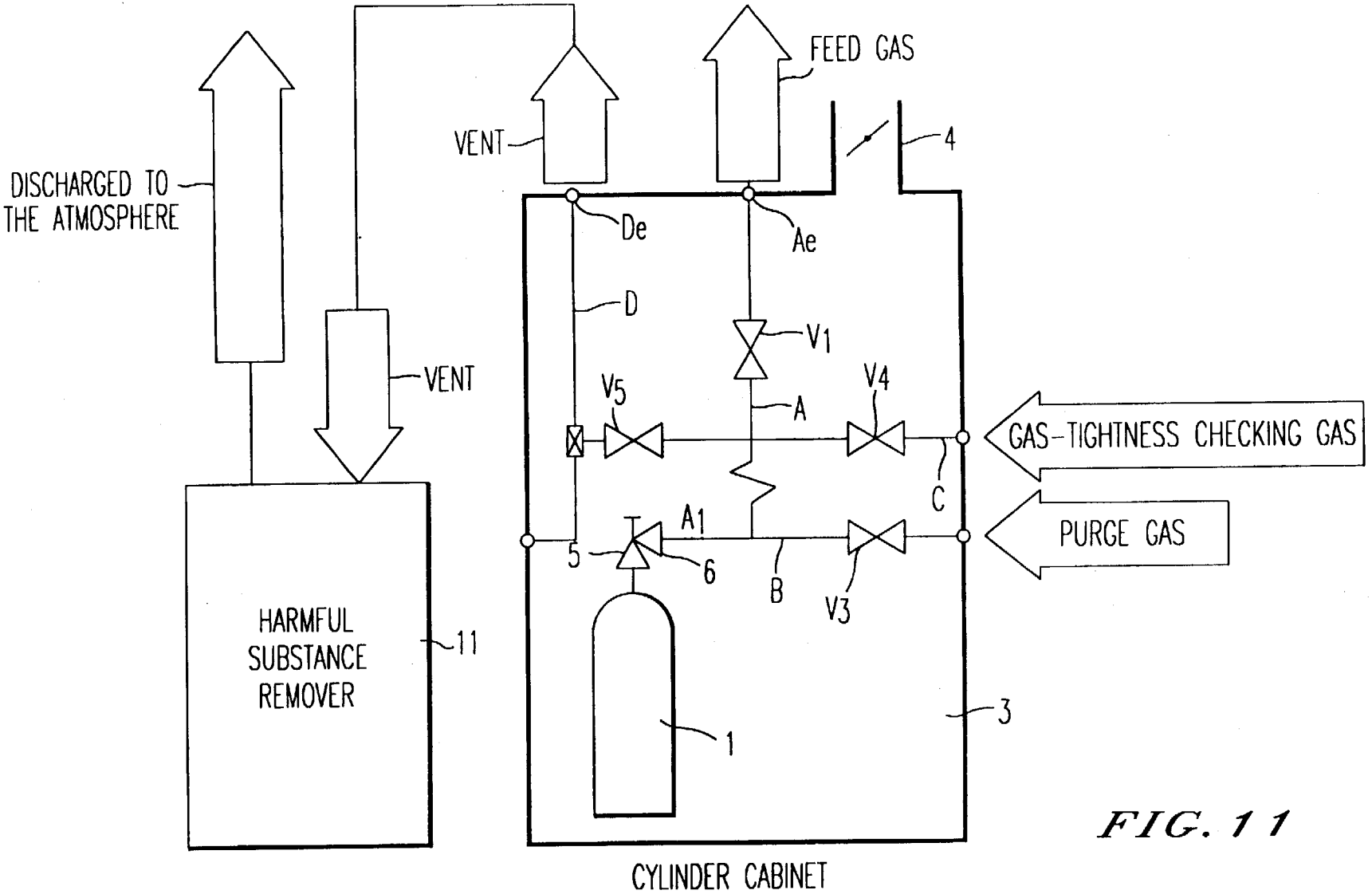
FIG. 11 is an illustrative view showing the problems of the gas supply system equipped with cylinders of the prior art.

1—cylinder, 2—semiconductor manufacturing unit, 3 and A—cylinder cabinet, 8—vacuum generator, 10—purge gas supply apparatus, 11—harmful substance remover, 12—pressure sensor, A—gas supply line, B—purge gas introduction line, C—gas-Lightness checking gas introduction line, D—vent line, V3, V4, V5, V7 and V8—valves, B1, C1, D1 and E—piping portions.

I claim:

1. A gas supply system equipped with cylinders, which comprises a gas supply line for leading a feed gas from a cylinder to gas consumption means, a line for leading an inert gas to said gas supply line, a negative pressure area defined between flow path blocking means provided therein, and pressure sensor means for detecting variation in gas pressure in said negative pressure area, at least one of an inflow of said feed gas to the inert gas line and an inflow of said inert gas to the feed gas supply line is detected by said pressure sensor means when pressure changes in said negative pressure area;

wherein said negative pressure area comprises selected first and second piping portions which are demarcatedly located in a purge gas introduction line by at least two valve means in series therein, and wherein a gas introduced in said first piping portion is in flow communication with a first vent line having first switching means for establishing a first and second flow path, a gas introduced in said portion is in flow communication with a second vent line having second switching means provided therein for establishing a second vent flow path, and further wherein said pressure sensor means is in gas flow communication with each of said selected first and second piping portions for detecting pressure changes in said selected negative pressure areas;

further wherein said first vent line is in fluid communication with said first switching means for venting said first negative pressure area when said first vent line is used, while said second switching means is closed, and when said second vent line is used, said first switching means is closed while establishing a gas flow communication between said second vent line and said first vent line.

2. The gas supply system of claim 1, in which at least said inert gas line is either a purge gas introduction line for leading a purge gas to the feed gas supply line and a gas-tightness checking gas introduction line for leading a gas-tightness checking gas to the connection portion of said cylinder and said gas supply line.

3. The gas supply system of claim 1, in which the feed gas flowed in the inert gas line and the inert gas flowed in the gas supply line is led to the vent line by way of vacuum generation means by detection with said pressure sensor means which detects an increase in pressure in said negative pressure area.

4. The gas supply system of claim 1, wherein said first and second vent lines are each connected to vacuum generator means.

5. The gas supply system of claim 1, wherein said gas consumption means is a semiconductor manufacturing unit.

6. A gas supply system equipped with cylinders, which comprises a feed gas filled in a plurality of cylinders, respectively, gas supply lines for separately leading the feed gas from the plurality of cylinders to gas consumption means, respectively, and lines for leading an inert gas from a single inert gas supply source To the plurality of said gas supply lines, respectively, wherein a negative pressure area is defined between flow path blocking means provided therein, at least between said feed gas supply lines and said inert gas lines, and pressure sensor means for detecting variation in gas pressure in said negative pressure area, at least one of an inflow of said feed gas to the inert gas lines and an inflow of said inert gas to the feed gas supply lines is detected by said pressure sensor means when pressure changes in said negative pressure area;

wherein said negative pressure area comprises selected first and second piping portions which are demarcatedly located in a purge gas introduction line by at least two valve means in series therein, and wherein a gas introduced in said first piping portion is in flow communication with a first vent line by having switching means for establishing a first and second flow path, a gas introduced in said second piping portion is in flow communication with a second vent line having second switching means provided therein for establishing a second vent flow path, and further wherein said pressure sensor means is in gas flow communication with each of said first and second piping portions for detecting pressure changes in said selected negative pressure areas;

further wherein said first vent line is in fluid communication with said first switching means for venting said first negative pressure area when said first vent line is used, while said second switching means is closed, and when said second vent line is used, said first switching means is closed while establishing a gas flow communication between said second vent line and said first vent line.

7. The gas supply system of claim 6, wherein at least said inert gas line is either a purged gas introduction line for leading a purged gas to the feed gas supply line and a gas-tightness checking gas introduction line for leading a gas-tightness checking gas to the connection portion of said cylinder and gas supply line.

8. The gas supply system of claim 6, wherein the feed gas flowed in the inert gas line and the inert gas flowed in the gas supply line is led to the vent line by way of vacuum generation means by detection with said pressure sensor means which detects an increase in pressure in said negative pressure area.

9. The gas supply system of claim 6, wherein said first and second vent lines are each connected to vacuum generator means.

10. The gas supply system of claim 6, wherein said gas consumption means is a semiconductor manufacturing unit.

11. A gas supply system equipped with cylinders, which comprises a plurality of cylinders accommodated in a gas supply apparatus, a feed gas filled in the plurality of said cylinders, respectively, gas supply lines whose branched upstream portions are, respectively, connected to the plurality of said cylinders, for leading the feed gas from a desired cylinder of the plurality of said cylinders to gas consumption means, and lines for leading an inert gas to the branched upstream portions of the gas supply lines, respectively, wherein a negative pressure area is defined between flow path blocking means provided therein, at least between the upstream portions of said feed gas supply lines and the inert gas lines, and pressure sensor means for detecting variation in gas pressure in said negative pressure area, at least one of an inflow of said feed gas to the inert gas lines and the inflow of said inert gas to the feed gas supply fines is detected by said pressure sensor means when pressure changes in said negative pressure area;

wherein said negative pressure area comprises selected first and second piping portions which are demarcatedly located in a purge gas introduction line by two valve means in series therein, and wherein a gas introduced in said first piping portion is in flow communication with a first vent line having first switching means for establishing a first vent flow path, a gas introduced in said second piping portion is in flow communication with a second vent line having second switching means provided therein, and further wherein said pressure sensor means is in gas flow communication with each of said first and second piping portions for detecting pressure changes in said selected negative pressure areas;

further wherein said first vent line is in fluid communication with said first switching means for venting said first negative pressure area when said first vent line is used, while said second switching means is closed, and when said second vent line is used, said first switching means is closed while establishing a gas flow communication between said second vent line and said first vent line.

12. The gas supply system of claim 11, wherein at least said inert gas line is either a purged gas introduction line for leading a purged gas to the feed gas supply line and a gas-tightness checking gas introduction line for leading a gas-tightness checking gas to the connection portion of said cylinder and gas supply line.

13. The gas supply system of claim 11, wherein the feed gas flowed in the inert gas line and the inert gas flowed in the gas supply line is led to the vent line by way of vacuum generation means by detection with said pressure sensor means.

14. The gas supply system of claim 6, wherein said first and second vent lines are each connected to vacuum generator means.

15. The gas supply system of claim 11, wherein said gas consumption means is a semiconductor manufacturing unit.

16. A gas supply system equipped with cylinders, which comprises a gas supply line for leading a feed gas from a cylinder to gas consumption means, the vent line provided branchedly from the gas supply line for discharging to the outside a gas remaining in the gas supply line for the purpose of purging when the gas supply is stopped, a negative pressure area defined between flow path blocking means provided therein, and a pressure sensor means for detecting variation in gas pressure in said negative pressure area, wherein the outflow of the feed gas to the vent line is detected by said pressure sensor means;

wherein said negative pressure area comprises selected first and second piping portions which are demarcatedly located in a purge gas introduction line by two valve means in series therein and wherein a gas introduced in said first piping portion is in flow communication with a first vent line having first switching means for establishing a first vent flow path, a gas introduced in said second piping portion is in flow communication with a second vent line having second switching means provided therein for establishing a second vent flow path, and further wherein said pressure sensor means is in gas flow communication with each of said selected first and second piping portions for detecting pressure changes in said selected negative pressure areas;

further wherein said first vent line is in fluid communication with said first switching means for venting said first negative pressure area when said first vent line is used, while said second switching means is closed, and when said second vent line is used, said first switching means is closed while establishing a gas flow communication between said second vent line and said first vent line.

* * * * *